US011280046B1

(12) United States Patent
Braden

(10) Patent No.: US 11,280,046 B1
(45) Date of Patent: Mar. 22, 2022

(54) DEVICE AND METHOD FOR PREVENTING LAUNDRY TANGLING

(71) Applicant: Global Concepts Limited Inc., Deerfield Beach, FL (US)

(72) Inventor: Laurie Braden, Boca Raton, FL (US)

(73) Assignee: Global Concepts Limited Inc., Deerfield Beach, FL (US)

( * ) Notice: Subject to any disclaimer, the term of this patent is extended or adjusted under 35 U.S.C. 154(b) by 0 days.

(21) Appl. No.: 17/499,045

(22) Filed: Oct. 12, 2021

(51) Int. Cl.
*D06F 95/00* (2006.01)
*D06F 59/02* (2006.01)

(52) U.S. Cl.
CPC ..... *D06F 95/008* (2013.01); *D06F 59/02* (2013.01)

(58) Field of Classification Search
CPC ..... D06F 95/008
See application file for complete search history.

(56) References Cited

U.S. PATENT DOCUMENTS 7,721,462 B2 5/2010 Park
2017/0260672 A1* 9/2017 Keyes ..... D06F 95/008
2020/0354882 A1 11/2020 Bray

OTHER PUBLICATIONS

Brayniacs LLC, "Wad-Free for Bed Sheets", https://wadfree.com/, downloaded on Oct. 7, 2021.

* cited by examiner

*Primary Examiner* — Jason Y Ko
(74) *Attorney, Agent, or Firm* — The Concept Law Group, PA; Scott D. Smiley

(57) ABSTRACT

An anti-tangling laundry device includes a body with two halves, each half having securing slots that hold the edges of a laundry item to prevent tangling of the laundry item during the washing process. The securing slots are closed off by a stopper plug that is sized and shaped to fit within the center of the body, so that any laundry item placed into the receiver remains in place throughout the laundry process.

15 Claims, 6 Drawing Sheets

DEVICE AND METHOD FOR PREVENTING LAUNDRY TANGLING

FIELD OF THE INVENTION

The present invention relates generally to laundry machines, and, more particularly, relates to a device and method for preventing items from tangling during the laundry process.

BACKGROUND OF THE INVENTION

A persistent problem with laundry is the propensity of laundry items to twist on themselves, tangle with or other items, or wad up into a ball. When these items are caught in one of the aforementioned configurations, significant portions of the surfaces of the items are pressed together, which prevents them from receiving water, soap, and/or the frictional cleaning abrasion process within the washing machine and during the washing process. Instead, dirty surfaces are pressed against other dirty surfaces and can remain that way throughout the entire laundry process. A similar process takes place in the dryer. There, wet surfaces are pressed against each other, thereby trapping moisture and preventing hot air from making contact with the materials. This results in moisture remaining at the end of the drying process and wrinkles being formed into the items. Additionally smaller loose items can get trapped or tangled inside an item tightly twisted or packed into a ball preventing it from being washed or dried resulting in re-starting the cycles.

To prevent items in the laundry from getting tangled, users must manually manipulate the items in the middle of the process to untangle them or untwist them. This may need to be done several times during the process. During the washing process, this requires the user to get their hands wet and covered in soap, which is sometimes hard to remove and generally unpleasant. During the drying process, the user has to open the door, which lets the heat escape. It can also result in the clean items being dropped onto the dirty floor. Stopping and opening the dryer can require the user to run extra cycles on the drier, which wastes energy and extends the required time.

Therefore, a need exists to overcome the problems with the prior art as discussed above.

SUMMARY OF THE INVENTION

The invention provides a device and method for preventing laundry tangling that overcomes the hereinafore-mentioned disadvantages of the heretofore-known devices and methods of this general type and that secures multiple areas of an item during the washing and/or drying process so that it cannot twist upon itself or get wadded up.

With the foregoing and other objects in view, there is provided, in accordance with the invention, an anti-tangling laundry body including: a first half having a first plurality of securing slots and defining a first opening through the first half; and a second half opposite the first half, the second half having a second plurality of securing slots and defining a second opening through the second half. The device also includes a stopper sized and shaped to fit within the first and second opening and removably couple to the body in a position that retains portions of a laundry item within either the first plurality of securing slots or the second plurality of securing slots.

Implementations may include one or more of the following features. The anti-tangling device where the body is substantially spherical in shape, the body is of a substantially flexible material, the substantially flexible material is at least one of silicone and rubber that can get wet and withstand the heat of dryers, and a plurality of securing slots or openings shaped and sized to securely hold portions of a laundry item.

One general aspect includes a tangle-free method of cleaning a laundry item providing an anti-tangling device that includes: a body including: a first half having a first plurality of securing slots and defining a first opening through the first half; and a second half opposite the first half, the second half having a second plurality of securing slots and defining a second opening through the second half. The method also includes a device with a stopper sized and shaped to fit within the first opening and the second opening and removably couple to the body in a position that retains objects within the first plurality of securing slots and the second plurality of securing slots; inserting a first corner of a laundry item into a first one of the first plurality of securing slots, inserting a second corner of the laundry item into a second one of the first plurality of securing slots. Then inserting a third corner of the laundry item into a third one of the first plurality of securing slots; inserting a fourth corner of the laundry item into a fourth one of the first plurality of securing slots; and inserting the stopper into the first opening and the second opening until the stopper is coupled to the body and retains the first, second, third, and fourth corners of the laundry item in the first, second, third, and fourth of the first plurality of securing slots.

Implementations may include one or more of the following features. The tangle-free method may include: passing each of the first, second, third, and fourth corners through the second opening and then the first opening prior to the inserting steps. The tangle-free method may include: placing the anti-tangling device and the laundry item into a clothes-washing machine; running the clothes-washing machine a full cleaning cycle. The tangle-free method may include: placing the anti-tangling device and the laundry item into a clothes-drying machine and running the clothes-drying machine a full cleaning cycle.

The tangle-free method may include: deforming at least a portion of each of the first, second, third, and fourth of the first plurality of securing slots while inserting each of the first, second, third, and forth corners of the laundry item into the respective first, second, third, and fourth of the first plurality of securing slots. The first plurality of securing slots can be key-hole-shaped openings. Each of the first plurality of securing slots has a pair of flexible walls that define a slot.

Although the invention is illustrated and described herein as embodied in a device and method for preventing laundry tangling, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. The invention comes in at least two sizes; a standard size and a plus (+) size, therefore the size does not limit the invention in any way. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the largest dimension of the anti-tangling device. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
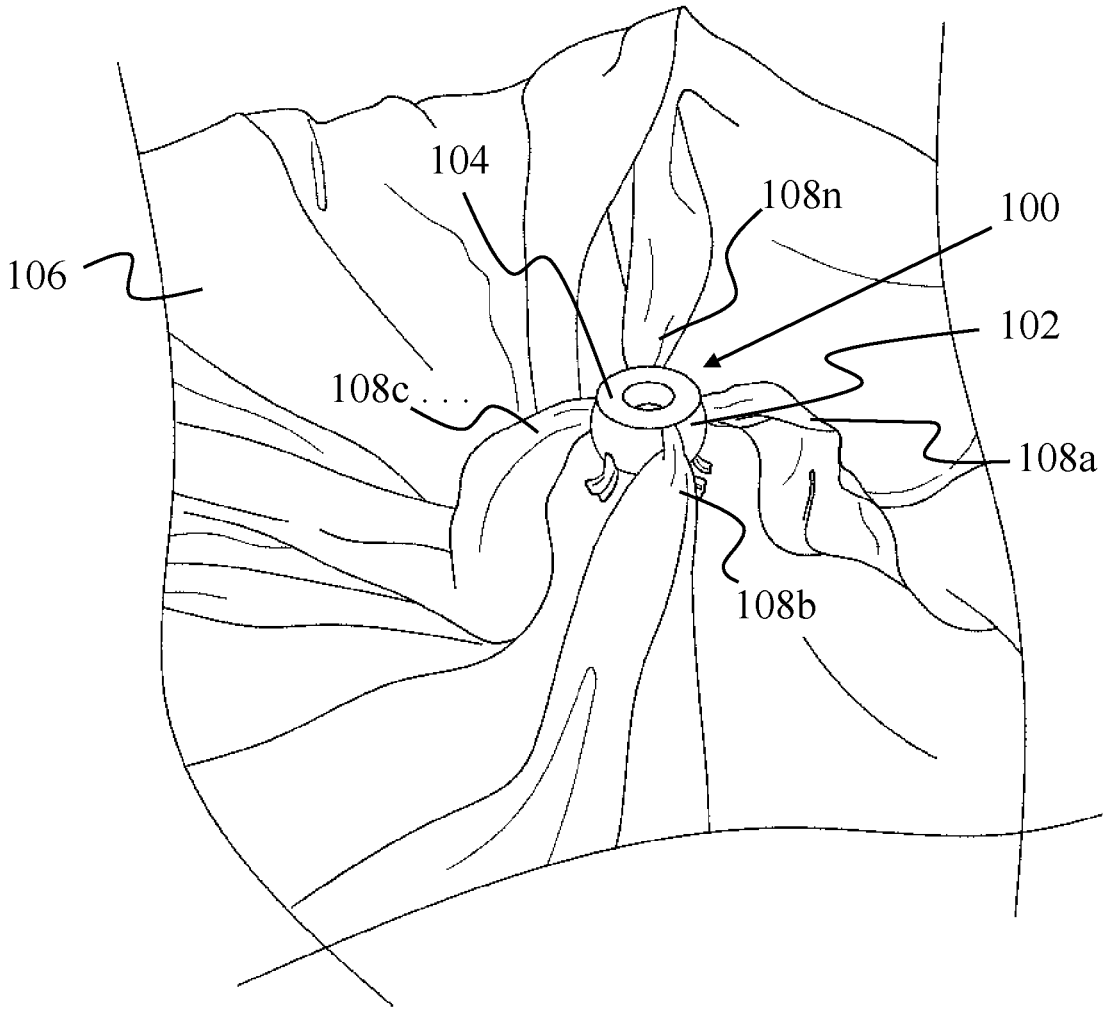
FIG. 1 is a fragmentary, perspective view of an anti-tangling laundry device securing four corners of a sheet in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method and device for holding multiple portions of a laundry item in a fixed configuration, thereby preventing tangling and twisting or bunching up inside another laundry item of the laundered item. Embodiments of the invention provide a device with multiple receiving areas, each capable of selectively receiving and holding a portion of the laundry item. In addition, embodiments of the invention provide a method of washing and drying a laundry item without tangling, the method including attaching multiple portions of a laundry item to a laundry holding device.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of an anti-tangling laundry device 100, as shown in FIG. 1, includes a body 102 and a stopper 104 that is attached to a laundry item 106, e.g., a sheet. The anti-tangling laundry device 100 is capable of accepting the corners 108*a-n* of the laundry item 106 and securing them, with help of the stopper plug 104, in the anti-tangling laundry device 100 throughout a laundry process. As used herein, the reference "a-n" is intended to indicate a range of items, where "a" equals 1 and "n" equals any number great than 1. The laundry process, as referred to herein, can include washing the sheet in a common washing machine and/or drying the sheet in a common dryer, both of which machines are commonly found in consumer's homes. It can also include other processes and is intended to include any process where laundry is treated and can be subject to tangling upon itself.

Figure 2:
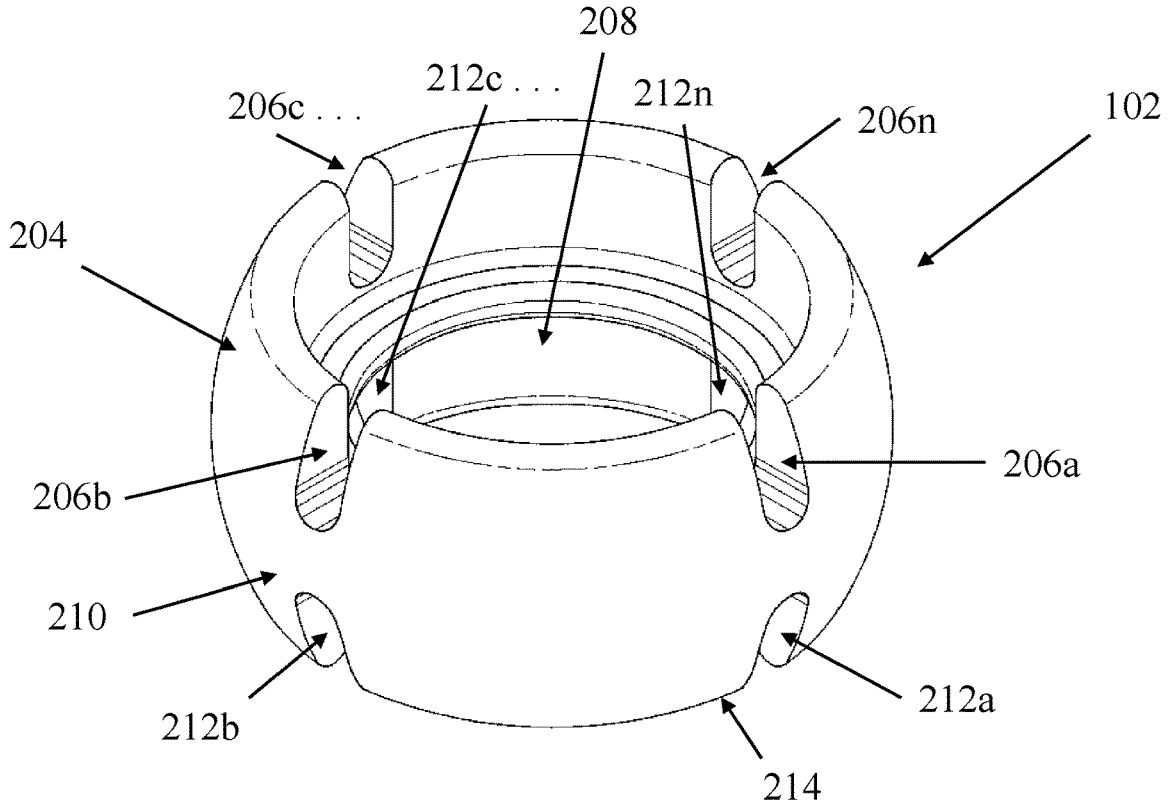
FIG. 2 is a perspective view of the body of the anti-tangling laundry device of FIG. 1, without the sheet or stopper shown in FIG. 1, in accordance with the present invention.

FIG. 2 shows a perspective view of the body 102 of the anti-tangling laundry device 100 of FIG. 1, without the laundry item 106 or stopper plug 104 shown in FIG. 1. In accordance with an embodiment of the present invention the body 102 is a single piece, but it can be considered to have two halves 204 and 210. The first half 204 half has a first plurality of securing slots 206*a-n*. In the embodiment shown, n equals 4. The first half 204 defines a first opening 208 through the first half 204. The body 102 can be considered to have a second half 210, opposite the first half 204. The second half 210 has a second plurality of securing slots 212*a-n*. The second half 210 defines a second opening 214 (not visible in this view) through the second half 210. The first opening 208 and the second opening 214 are one continuous opening through the body 102. The reference to two separate openings is for the purpose of clarification of the description of the present invention. The body 102 is substantially spherical in shape in the embodiment shown, but a spherical shape is not necessary and the invention contemplates and can be formed in many other shapes.

Figure 3:
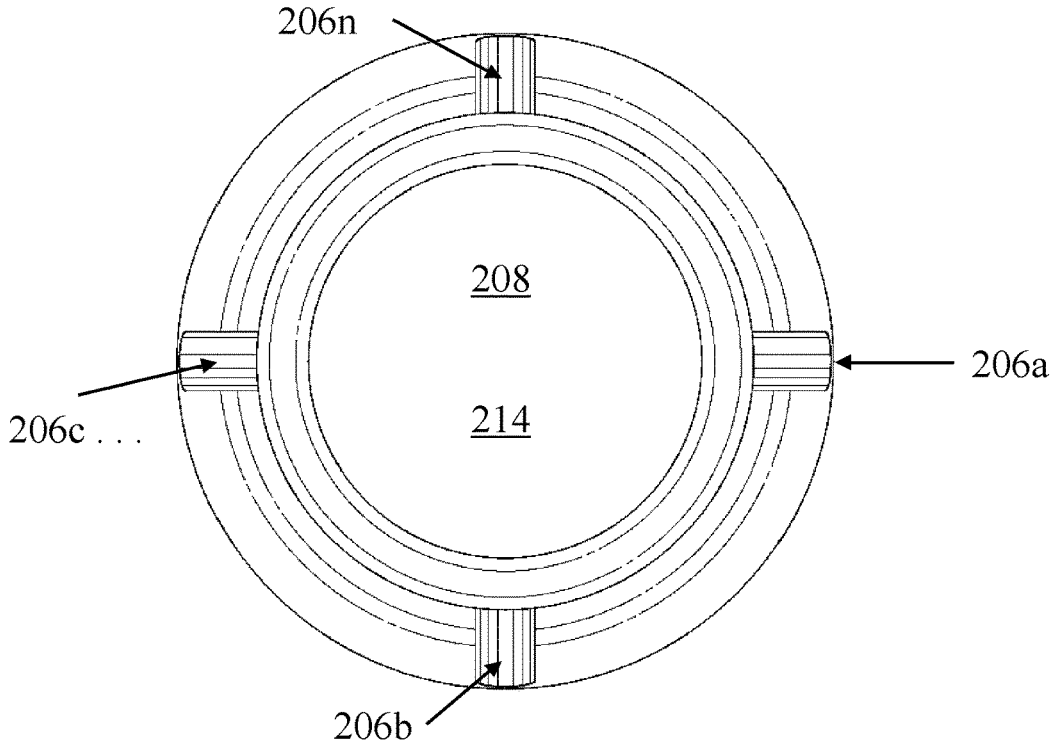
FIG. 3 is a top plan view of the body of the anti-tangling laundry device of FIG. 1, without the sheet or stopper shown in FIG. 1, in accordance with the present invention.

FIG. 3 is a top plan view of the body 102 of the anti-tangling laundry device 100 of FIG. 1, without the sheet 106 or stopper 104 shown in FIG. 1, in accordance with the present invention. The first 208 and second 214 openings, which are connected and can also be considered to be the same opening, are visible in this view. The first plurality of securing slots 206*a-n* are also visible in this view. In the depicted embodiment, the bottom plan view looks the same as the top plan view shown in FIG. 3.

Figure 4:
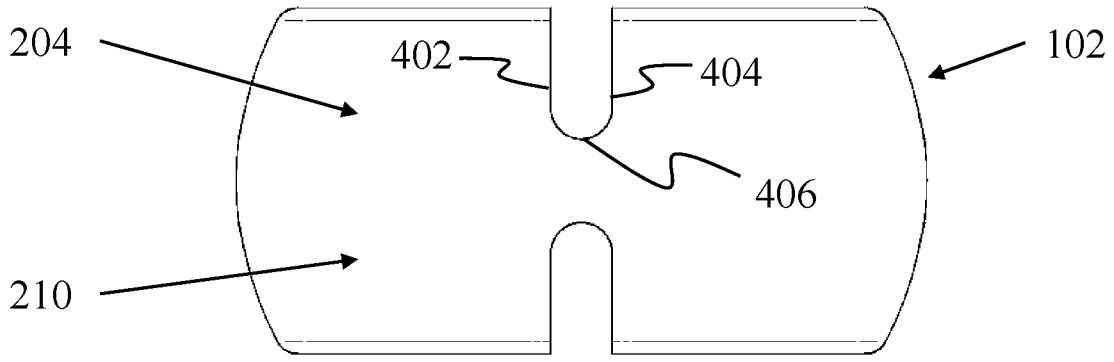
FIG. 4 is an elevational side view of the body of the anti-tangling laundry device of FIG. 1, without the sheet or stopper shown in FIG. 1, in accordance with the present invention.

The elevational side edge view of FIG. 4 shows the symmetry between the mirrored halves 204, 210 of the body 102. The view also shows one embodiment of the securing slots 206*a-n*. In this embodiment, the securing slots 206*a-n* resemble a U-shaped slot in the body 102, which is depicted as having two walls 402 and 404 and the slot ends at terminus 406. The body 102, in some embodiments, is made of flexible material, such as rubber, silicone, or any other material that expresses flexibility while retaining its shape. The flexible material allows the user to deform at least a portion of each of the first 206*a*, second 206*b*, third 206*c*, and fourth 206*n* of the first plurality of securing slots while inserting each of the first, second, third, and forth corners of a laundry item 106 into the respective first 206*a*, second 206*b*, third 206*c*, and fourth 206*n* of the first plurality of securing slots. In some embodiments, the securing slots are key-hole-shaped, which means the terminus section 406 has a larger dimension than the distance between the first and second walls 402 and 404 forming the opening of the slot, e.g., similar to the opening profile for a skeleton key.

Figure 5:
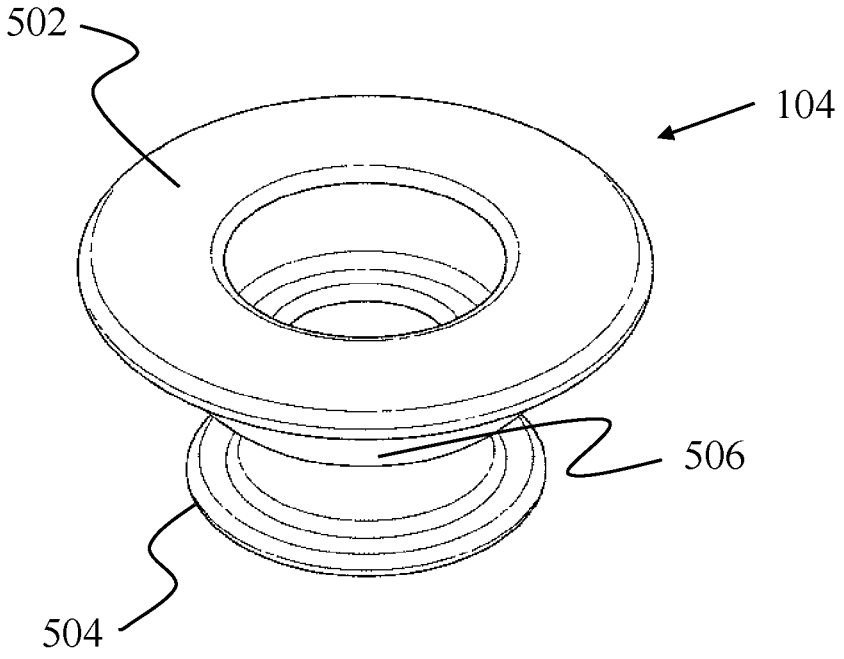
FIG. 5 is a perspective top view of the stopper of the anti-tangling laundry device of FIG. 1, in accordance with the present invention.

FIG. 5 provides a downward-looking perspective view of the stopper plug 104 of the anti-tangling laundry device 100 of FIG. 1. The stopper plug 104 is sized and shaped to fit within the first opening 208 and the second opening 214 and removably couple to the body 102 in a position that retains objects within the first plurality of securing slots 206*a-n* and/or the second plurality of securing slots 212*a-n*. The stopper plug 104 has an upper surface 502, a lower surface 504, and a stopper plug body 506 separating the two surfaces 502, 504 from one another. The distance between the upper surface 502 and lower surface 504 is dictated by the height of the body 102.

Figure 6:
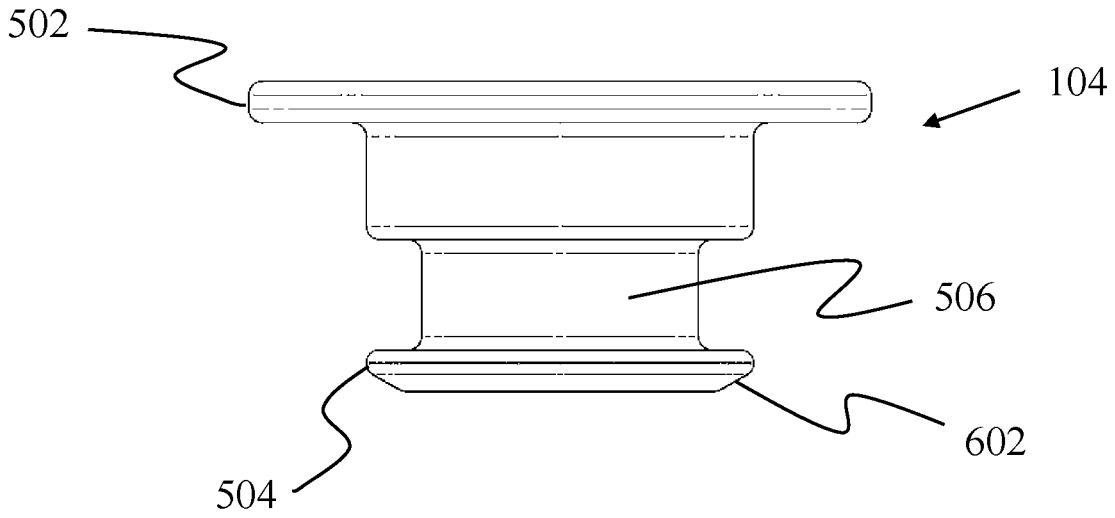
FIG. 6 is an elevational side view of the stopper of the anti-tangling laundry device of FIG. 1, in accordance with the present invention.

FIG. 6 provides an elevational side view of the stopper plug 104. This view shows that the lower surface 504, in this particular embodiment, has a tapered edge 602. Such an edge is not required, but helps the stopper plug more easily be inserted within the openings 208 and 214. The upper surface 502 is shown with a formidable thickness, relative to its width, and can be used as a surface for a user to assert pressure on the stopper plug 104 so as to insert it tightly into the body 102. Once firmly inserted, the stopper plug 104 securely and frictionally couples to the body 102. The upper surface 502 is sized to be larger than the first and second openings 208, 214.

Figure 7:
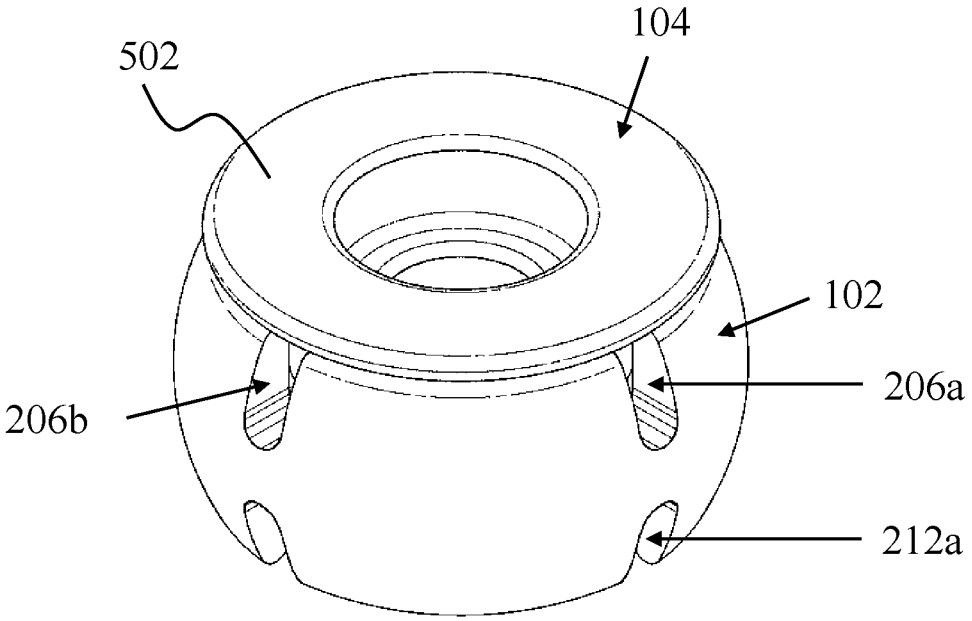
FIG. 7 is a perspective top view of the anti-tangling laundry device of FIG. 1, in accordance with the present invention.

FIG. 7 shows that the upper surface 502 of the stopper 104 has a large enough outer dimension to overlap the securing slots 206*a-n* or 212*a-n*, depending on which direction the stopper 104 is inserted into the body 102. When the stopper 104 is inserted into the body 102 in this manner, it traps portions 108*a-n* of a laundry item that have been inserted into the securing slots 206*a-n* and prevents them from being pulled out of the receiver in the longitudinal direction of the receiver slot. The laundry item 106 will also be frictionally retained by the stopper body 506, which holds a portion of the laundry item tight against an inside wall of the body 102. The two sizes of the anti-tangling laundry device 100—the standard and the plus (+) size—are for different weight (thickness) of laundry items and are intended to provide a strong frictional connection of the stopper plug 104 to the device body 102. However, the sizes are not indicative of the design and can vary and be made of various shapes and sizes.

Further, and, although not required, if the laundry item 106 is pulled into the body far enough, it can be placed into both one of the first set of securing slots 206 and one of the second set of securing slots 212. This is shown in FIG. 1, where the ends 108*a-c* of the laundry item 106 can be seen extending out of the lower securing slots. The lower surface 504 of the stopper plug 104 will block the item from being removed from the second receiver 212 and the upper surface 502 will block the laundry item from being removed from the first receiver 206.

Figure 8:
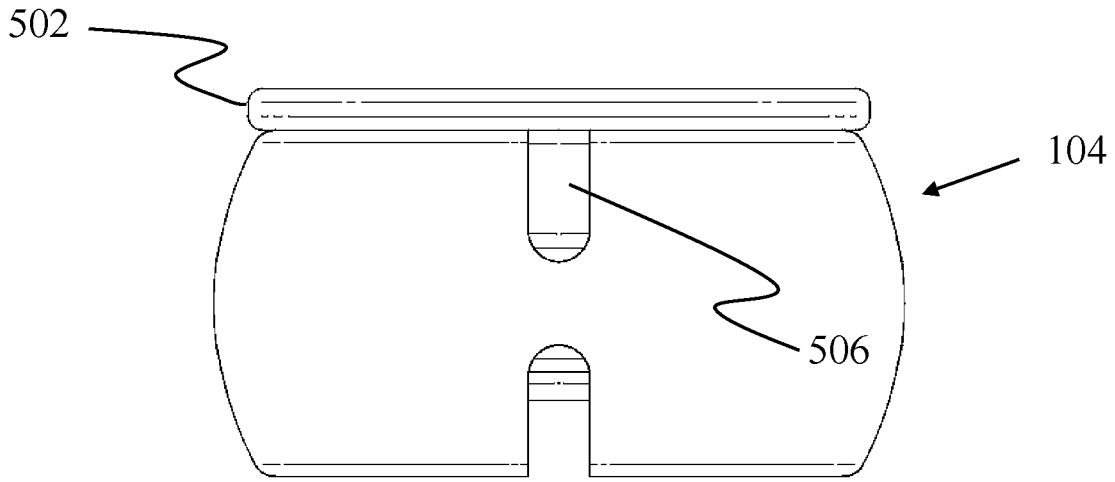
FIG. 8 is an elevational side view of the anti-tangling laundry device of FIG. 1, in accordance with the present invention.

FIG. 8 is an elevational side view of the anti-tangling laundry device of FIG. 1 with the stopper plug 104 shown inserted within the body 102, in accordance with the present invention.

Figure 9:
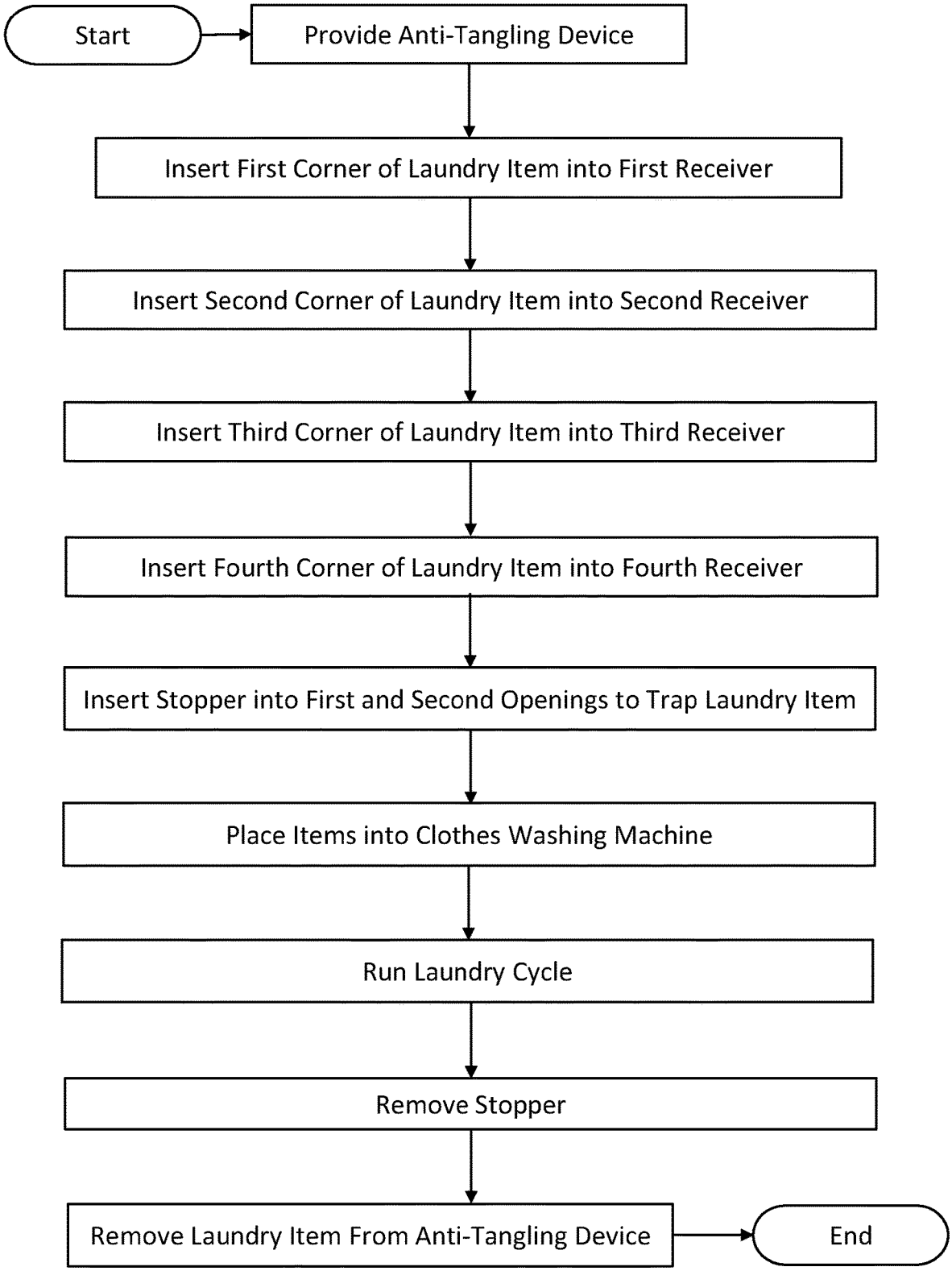
FIG. 9 is a process flow diagram of a method of using the anti-tangling laundry device of FIG. 1 in accordance with the present invention.

FIG. 9 is a process flow diagram of a method of using the anti-tangling laundry device of FIG. 1 in accordance with the present invention. Although FIG. 9 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 9 for the sake of brevity. In some embodiments, some or all of the process steps included in FIG. 9 can be combined into a single process.

A tangle-free method 900 of cleaning a laundry item starts with step 902 and moves directly to step 904, where an anti-tangling device is provided, such as device 100 shown in FIG. 1. In step 906, a first corner of a laundry item 106 is inserted into a first one of the first plurality of securing slots, such as receiver 206*a* shown in FIG. 2. In step 908, a second corner of the laundry item 106 is inserted into a second one of the first plurality of securing slots, such as receiver 206*b* shown in FIG. 2. In step 910, a third corner of the laundry item 106 is inserted into a third one of the first plurality of securing slots, such as the third receiver 206*c* shown in FIG. 2. In step 912, a fourth corner of the laundry item 106 is inserted into a fourth one of the first plurality of securing slots, such as receiver 206*n* shown in FIG. 2.

In step 914, the stopper plug 104 is inserted into the first opening 208 and through to the second opening 214 until the stopper plug 104 removably, yet securely, couples to the body 102 and retains the first, second, third, and fourth corners of the laundry item in the first, second, third, and fourth of the first plurality of securing slots.

In step 916, the anti-tangling device 100 and laundry item 106 are placed into a clothes-washing machine. In step 918, the clothes-washing machine is run through a full cleaning cycle which, may or may not include the drying cycle. In step 920, the stopper plug 104 is removed from the body 102, exposing the securing slots 206*a-n* or 214*a-n*. In step 922, the laundry item 106 is removed from the anti-tangling device 100, where it is untangled and convenient and easy to fold. The process ends at step 920.

An anti-tangling device has been disclosed that easily accepts portions of a laundry item and holds those portions throughout the laundry cleaning process so that it does not get tangled.

The claims appended hereto are meant to cover all modifications and changes within the scope and spirit of the present invention.

What is claimed is:

1. An anti-tangling laundry device comprising:

a body including:

a first half having a first plurality of securing slots and defining a first opening through the first half; and a second half opposite the first half, the second half having a second plurality of securing slots and defining a second opening through the second half; and a stopper plug sized and shaped to fit within the first opening and the second opening and removably couple to the body in a position that retains objects within the first plurality of securing slots and the second plurality of securing slots.

2. The anti-tangling device according to claim 1, wherein: the body is substantially spherical in shape.

3. The anti-tangling device according to claim 1, wherein: the body is of a substantially flexible material.

4. The anti-tangling device according to claim 3, wherein: the substantially flexible material is at least one of silicone and rubber.

5. The anti-tangling device according to claim 1, wherein: the first plurality of securing slots are key-hole-shaped openings.

6. The anti-tangling device according to claim 1, wherein: the first plurality of securing slots is four securing slots.

7. The anti-tangling device according to claim 1, wherein: each of the first plurality of securing slots has a pair of flexible walls that define a slot.

8. A tangle-free method of cleaning a laundry item, the method comprising:

providing an anti-tangling device that includes:

a body including:

a first half having a first plurality of securing slots and defining a first opening through the first half; and a second half opposite the first half, the second half having a second plurality of securing slots and defining a second opening through the second half; and a stopper plug sized and shaped to fit within the first opening and the second opening and removably couple to the body in a position that retains objects within the first plurality of securing slots and the second plurality of securing slots;

inserting a first corner of a laundry item into a first one of the first plurality of securing slots;

inserting a second corner of the laundry item into a second one of the first plurality of securing slots;

inserting a third corner of the laundry item into a third one of the first plurality of securing slots;

inserting a fourth corner of the laundry item into a fourth one of the first plurality of securing slots; and inserting the stopper plug into the first opening and through the second opening until the stopper removably couples with the body and retains the first, second, third, and fourth corners of the laundry item in the first, second, third, and fourth of the first plurality of securing slots.

9. The tangle-free method according to claim 8, further comprising:

passing each of the first, second, third, and fourth corners through the second opening and then the first opening prior to the inserting steps.

10. The tangle-free method according to claim 8, further comprising:

placing the anti-tangling device and the laundry item into a clothes-washing machine;

running the clothes-washing machine a full cleaning cycle.

11. The tangle-free method according to claim 8, wherein: the body is substantially spherical in shape.

12. The tangle-free method according to claim 8, further comprising:

deforming at least a portion of each of the first, second, third, and fourth of the first plurality of securing slots while inserting each of the first, second, third, and forth corners of the laundry item into the respective first, second, third, and fourth of the first plurality of securing slots.

13. The tangle-free method according to claim 12, wherein:

each of the first, second, third, and fourth securing slots are at least partially made of at least one of silicone and rubber.

14. The tangle-free method according to claim 8, wherein: the first plurality of securing slots are key-hole-shaped openings.

15. The tangle-free method according to claim 8, wherein: each of the first plurality of securing slots has a pair of flexible walls that define a slot.

* * * * *